United States Patent [19]

Hogg

[11] Patent Number: 4,978,013

[45] Date of Patent: Dec. 18, 1990

[54] COLLAPSIBLE DISPLAY RACK

[75] Inventor: Howard Hogg, Oakville, Canada

[73] Assignee: Cole's Quality Foods, Inc., Muskegon, Mich.

[21] Appl. No.: 370,635

[22] Filed: Jun. 23, 1989

[51] Int. Cl.[5] ..... A47F 5/00

[52] U.S. Cl. ..... 211/181; 211/132; 211/149; 211/186; 211/195; 280/79.3

[58] Field of Search ..... 280/47.35, 47.19, 79.3; 211/71, 181, 195, 149, 132, 186

[56] References Cited

U.S. PATENT DOCUMENTS

| | | | |
|---|---|---|---|
| 2,118,461 | 5/1938 | Dempsey | 211/181 |
| 2,680,522 | 6/1954 | Temple | 211/181 X |
| 3,183,862 | 5/1965 | Melvin | 211/149 X |
| 3,252,434 | 5/1966 | Young | 211/181 X |
| 3,332,558 | 7/1967 | Wilson | 211/195 X |
| 3,834,724 | 9/1974 | Trubiano | 280/79.3 X |
| 3,915,097 | 10/1975 | Young | 211/181 X |
| 3,977,529 | 8/1976 | Stroh | 211/181 X |
| 4,313,544 | 2/1982 | Ashton | 211/181 |
| 4,895,382 | 1/1990 | Anderson | 280/79.3 X |

OTHER PUBLICATIONS

Photographs of experimental prototype of movable rack assembly provided at no charge to retail store and food brokers for experimental use, Oct.-Dec., 1987 by Cole's quality Foods, Inc. of Muskegon, Mich. (assignee of the present invention).

United States Patent application Ser. No. 07/292,389, filed Dec. 30, 1988, entitled "Movable Display Rack" Invented by Bertram J. Cain.

*Primary Examiner*—Robert W. Gibson, Jr.

*Attorney, Agent, or Firm*—Price, Heneveld, Cooper, DeWitt & Litton

[57] ABSTRACT

A rack assembly which is collapsible for storage and transportation but may be assembled to support and display products such as bread and other bakery goods. Preferably, the rack includes spaced lateral supports hinged to a back support, a plurality of vertically spaced, removable shelves, and wheels allowing the rack to be tilted rearwardly and moved about on a support surface or floor after assembly. Fastening means are included for removably securing the shelves to engaging means on the lateral and back supports. A pivotable header support on the upper rear of the rack supports an advertising display above the shelves.

12 Claims, 5 Drawing Sheets

Fig. 12.
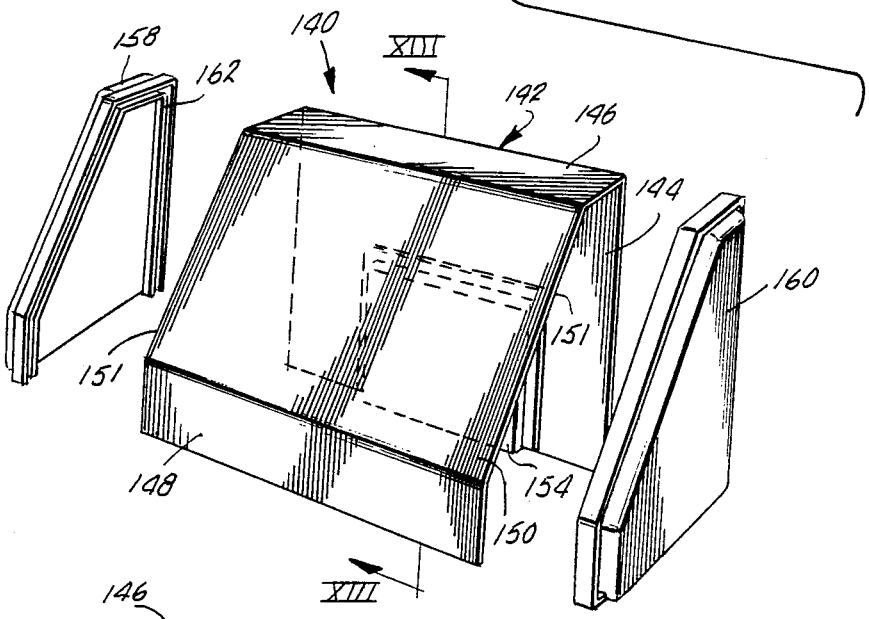
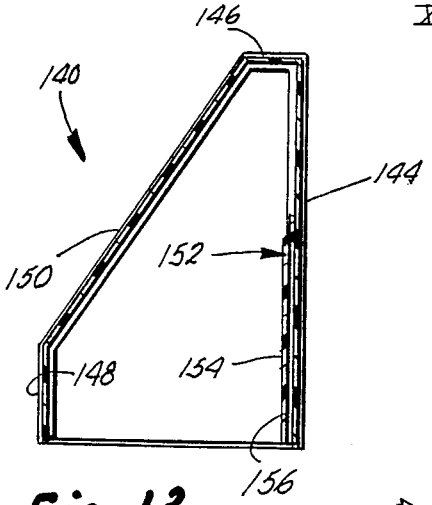
Fig. 13.
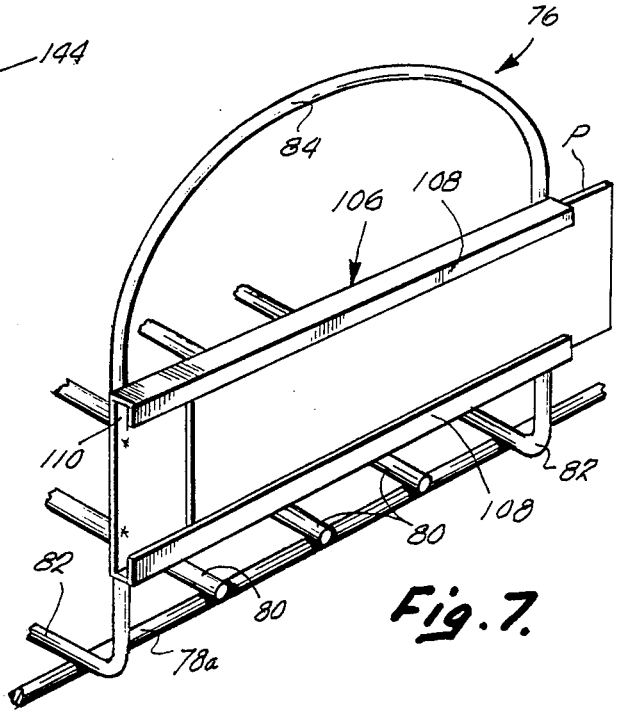
Fig. 7.

COLLAPSIBLE DISPLAY RACK

BACKGROUND OF THE INVENTION

This invention relates to display devices for various goods including groceries, baked goods and the like, and, more particularly, to a collapsible product display rack assembly especially adapted for assembly and disassembly for storage and transportation. When assembled, the rack assembly provides support and display of food items such as bread loaves and the like and allows convenient movement of the display from place to place in a retail store or other location.

Display equipment for bakery products in a typical grocery store includes a conventional series of stationary shelves or bins into which bread or other baked goods are placed by store personnel from baskets or other containers used to carry the product from a remote storeroom. Replenishing the shelves, therefore, is fairly time consuming, as well as requiring constant surveillance to prevent the shelves or bins from becoming unattractive. Moreover, the product must be displayed in certain specific locations of the store, too often not in an optimum location for attracting attention to specials or other sale items.

Typically, hand carts and other small vehicles have been used to move products from place to place in a grocery and other store However, an alternative to such carts is disclosed in co-pending, commonly assigned, U.S. patent application Ser. No. 07/292,389, filed Dec. 30, 1988, entitled "MOVABLE DISPLAY RACK" invented by Bertram J. Cain. The movable display rack of Ser. No. 07/292,389 is especially adapted to permit loading of products such as bread or other food items in one area of a store followed by wheeled movement of the loaded rack assembly to another store location Thus, various products may be displayed in an organized, pleasing manner which allows convenient access to the goods by the consumer.

The rigid upright display rack of Ser. No. 07/292,389 is permanently welded together As such, because of its size, it is difficult to transport to a retail establishment from a manufacturer and, likewise, is also difficult to store at the retail location when not in use. In addition, in the permanently assembled movable rack, should a shelf assembly or lateral support, axle or the like become damaged or bent while in transit or use, repair and replacement of individual sections is difficult and may often require replacement of the entire assembly.

Therefore, the need was apparent for an improved version of the movable display rack assembly which would allow disassembly for storage and transportation, but would allow quick, simple assembly when desired and/or simplified repair and replacement of various parts as needed, all while retaining the numerous advantages of the movable display rack of Ser. No. 07/292,389.

SUMMARY OF THE INVENTION

Accordingly, the present invention provides a collapsible rack assembly for storing and displaying products including bakery goods which may be easily assembled for use but quickly disassembled for storage and/or transportation. In the preferred embodiments, the rack assembly is movable from place to place to provide convenient and attractive display of the product for retail and other sales.

In one form, the collapsible rack assembly includes a foldable support assembly having a back support, a pair of lateral supports pivotally secured to the back support, and engaging means for holding a plurality of shelf assemblies on the back and lateral supports. A plurality of removable shelf assemblies is mounted at vertically spaced positions on the support assembly for access at least from the front of the rack assembly Each shelf assembly has a support area for retaining items thereon as well as fastening means for removably securing the shelf assemblies to the engaging means. Surface engaging means are provided at the bottom end of the foldable support assembly to support the rack assembly in a generally upright position on a support surface or floor.

Preferably, wheels are included to allow the rack assembly to be tilted rearwardly and moved about on the support surface or floor. Also, the shelf assemblies preferably include a lower support shelf, a back retention area, as well as front retention elements for retaining items on the shelves at the front. The lateral supports also preferably include side retention means adjacent and spaced above each shelf to retain items at the sides of the shelves.

An advertising header is preferably mounted on a pivotable header support on the back retention area of the topmost shelf assembly and is pivotable between an upright position extending above the lateral supports and a lowered position extending downwardly along the back support.

The preferred hinged support assembly may be disassembled and folded for transportation and storage but unfolded t o a generally U shape receiving the vertically spaced shelf units during assembly. The wheels may be removably secured to stub axles mounted at the rear and bottom of each lateral support.

In another form, the invention is a kit for making a collapsible rack assembly for food and other products including a foldable support assembly having a pair of lateral supports hinged to a back support and engaging means for holding a plurality of shelf assemblies. The lateral supports include top and bottom ends, surface engaging means at the bottom ends, and wheel support means spaced from the surface engaging means. The kit also includes a plurality of removable shelf assemblies each having a support area for retaining items thereon, and fastening means for removably securing the shelf assemblies to the engaging means. A pair of wheels is include for mounting on the wheel support means.

The collapsible rack assembly is especially adapted to permit loading of products such as bread in one area of a store followed by movement of the loaded rack assembly to another store location for organized, pleasing display of various products in a manner which allows convenient access to the goods by the consumer. However, when use of the rack is completed, it may be disassembled and stored piece-by-piece without consuming a large amount of storage space. Likewise, it may be easily transported in collapsed form to save transportation costs and conveniently assembled at the store location before use. When assembled, the collapsible rack assembly is highly maneuverable, lightweight, and yet stable since the wheels which enable movement of the rack from place to place are positioned at the rear of the unit causing the weight of the shelves and any products thereon to urge a forward portion downwardly against the floor or other support surface preventing the rack from being easily knocked over in high traffic areas. In addition, the pivotable advertising header displays advertising, trademarks or other product information above the rack assembly in a conspicuous, highly visible display area. Further, product labels may be placed on individual front retention elements on each shelf so that product variations can be displayed on a shelf-by-shelf basis.

These and other objects, advantages, purposes and features of the invention will become more apparent from a study of the following description taken in conjunction with the drawings.

BRIEF DESCRIPTION OF THE DRAWINGS

FIG. 7 is an enlarged, fragmentary, perspective view of the front retention member included on each shelf assembly, such retention member including a card/paper holder for product or other information thereon;

FIG. 12 is an exploded, perspective view of the advertising header adapted to be supported on the pivotable header support at the top of the collapsible rack assembly; and FIG. 13 is a sectional, side elevation of the advertising header taken along plane XIII—XIII of FIG. 12.

DESCRIPTION OF THE PREFERRED EMBODIMENT

Figure 1:
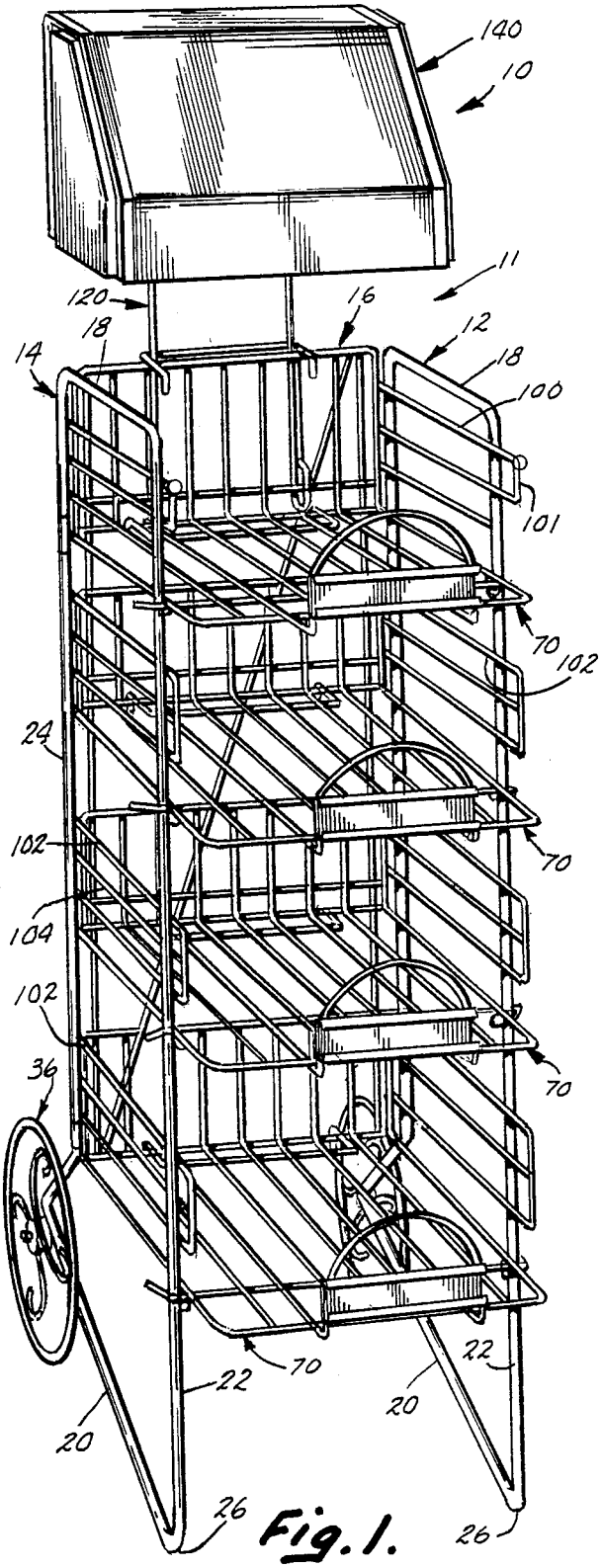
FIG. 1 is a front perspective view of the collapsible rack assembly of the present invention when assembled and incorporating an advertising header above the top shelf.
Figure 2:
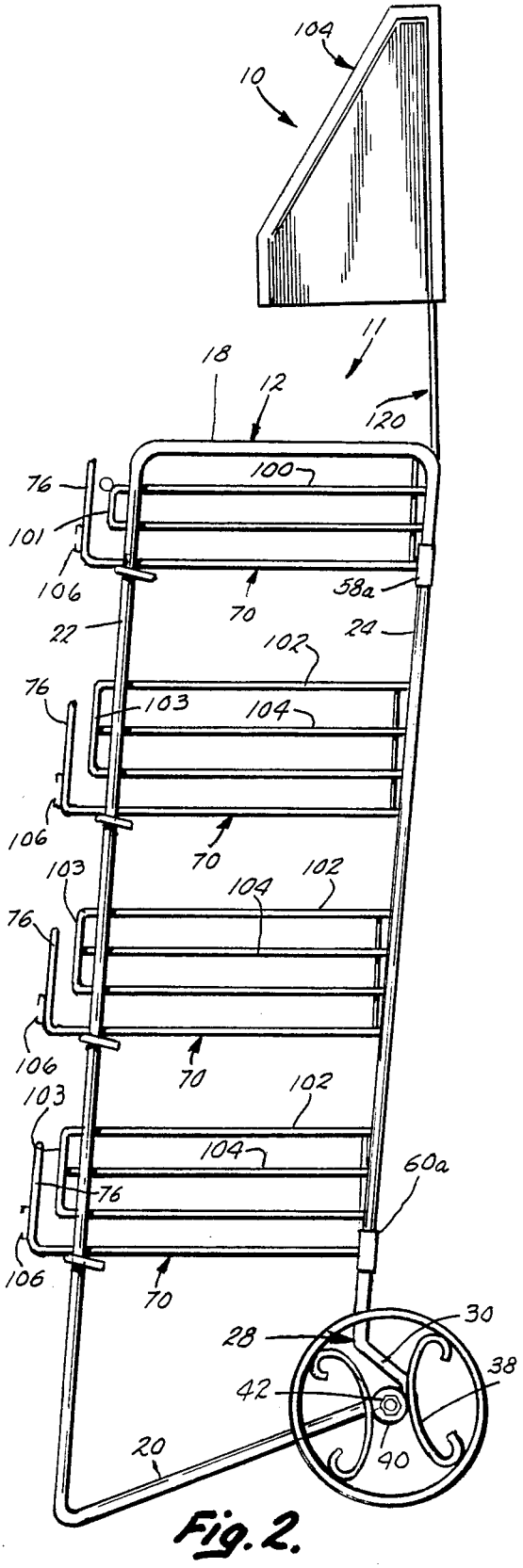
FIG. 2 is a right side elevation of the assembled collapsible rack assembly of FIG. 1.

Referring now to the drawings in greater detail, FIGS. 1 and 2 illustrate a preferred form 10 of the collapsible display rack assembly of the present invention. Rack assembly 10 includes a folding support assembly 11 having a pair of spaced, trapezoidal, lateral supports 12, 14 hingedly secured to a back support 16 for pivotable, folding movement. The lateral supports include surface or floor engaging areas 26 and wheels 36 for stable, upright support on a support surface or floor. Wheels 36 allow tilting of the rack assembly for movement about the floor or support surface When unfolded, support assembly 11 secures therein a series of four vertically spaced shelf units 70 on which product including bakery goods such as bread loaves and the like may be assembled, stored and displayed for purchase in a grocery or other store An advertising header 140 is spaced above the topmost shelf unit 70 to provide a highly visible area on which product designations and other indicia may be imprinted or attached. As described below, each of the shelf units 70 may be disassembled from the folding support assembly 11 such that lateral supports 12, 14 may be folded and collapsed with respect to back support 16 for ease in transportation and storage.

Figure 3:
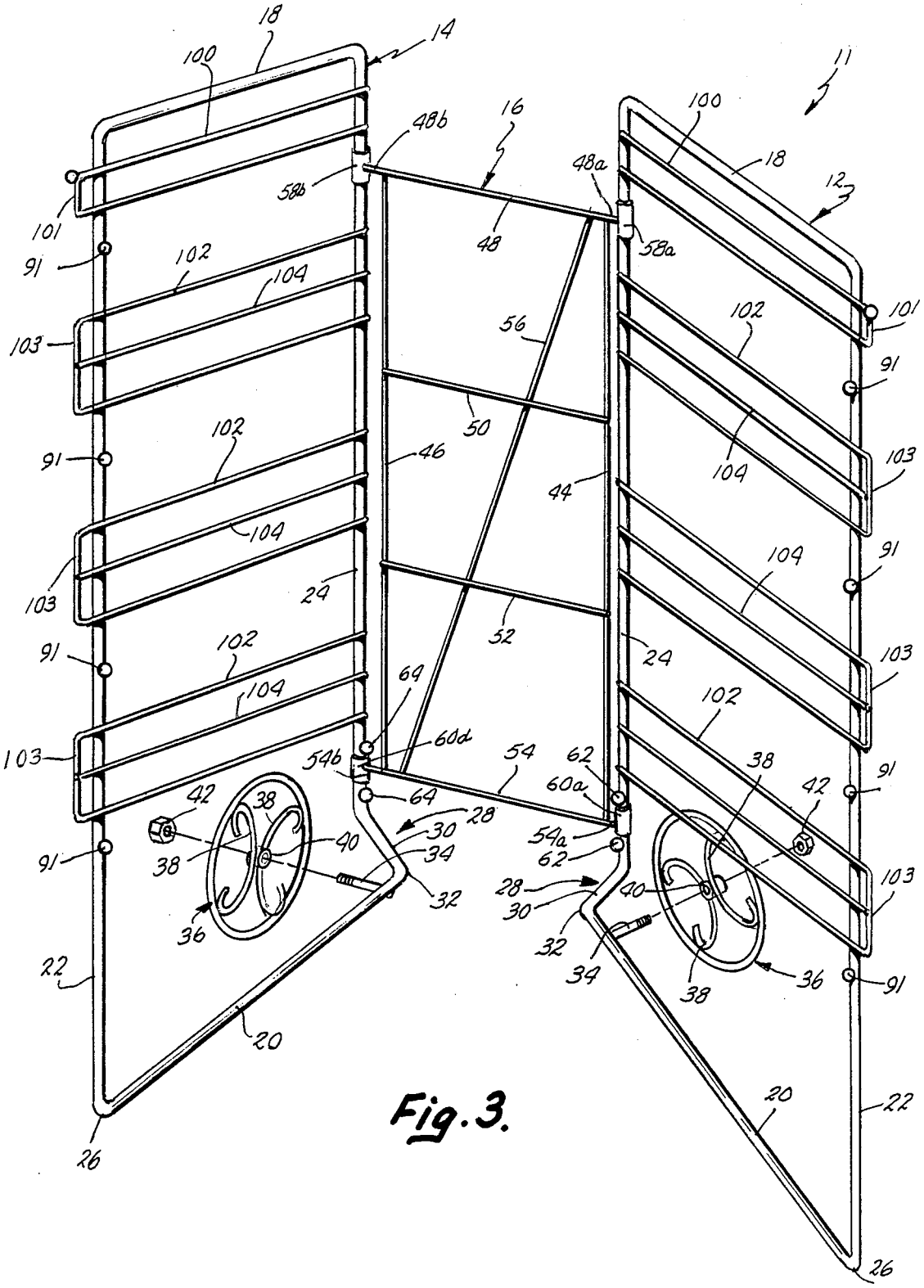
FIG. 3 is a perspective, exploded view of the foldable support assembly and removable wheels of the present invention disassembled.

As is best seen in FIG. 3, lateral supports 12, 14 are hingedly secured to back support 16 and are mirror images of one another. Each lateral support is a trapezoidal framework including top bar 18, bottom bar 20, and front and rear legs 22, 24 respectively The lateral supports are preferably formed from a continuous quarter inch steel rod or wire having a circular cross section and bent to the desired outline shape. However, other sized rod having different cross-sectional configurations may also be used. Front legs 22 are longer than rear legs 24 but are parallel to one another and extend generally vertically upwardly and slightly rearwardly with respect to the vertical when the rack is assembled and supported on a generally horizontal support surface as shown in FIGS. 1 and 2. In addition, top bars 18 slope slightly downwardly and forwardly and are generally parallel to shelf areas 72 of shelf units 70. Bottom bars 20 slope downwardly and forwardly at a greater angle than top bars 18 from a position adjacent the bottom end of rear legs 24 to the bottom end of longer front legs 22. Each bottom bar 20 is bent to join its respective front leg 22 at the forward, lower end of the assembly below the front leg to form a floor or support surface engaging area 26.

A rearward extension 28 is provided at the bottom end of each rear leg 24 as shown in FIGS. 2 and 3. Each rearward extension 28 includes a downwardly and rearwardly sloping diagonal rod or bar 30 which joins bottom bar 20 at apex 32. The rearward extension 28 provides an additional area spaced rearwardly from the position of rear legs 24 on which stub axles 34 are mounted to extend outwardly at a right angle to the plane of lateral supports 12, 14. Preferably, stub axles 34 are welded to the bottom of bar 20 slightly forwardly of apex 32 and include threaded outer ends. Each axle receives a wheel 36 formed from shaped wire or rod and having configured spokes 38 between which is secured a hollow hub 40 received over the end of stub axles 34. Threaded lock nuts 42 are screwed to the ends of stub axles 34 to retain the wheels 36 in place and to allow rotation of hubs 40 on stub axles 34.

As is also seen in FIG. 3, back support 16 is a rectangular framework also formed from bent wire or rod but having a diameter slightly less than that from which lateral supports 12, 14 are made. Back support 16 includes a pair of generally vertical upright members 44, 46 between which are welded or otherwise secured vertically spaced, horizontal bars 48, 50, 52 and 54. An elongated rectilinear diagonal brace 56 is welded across the rear side of bars 48-54 for rigidity and strength.

Lateral supports 12, 14 are pivotally hinged to back support 16 by means of two pair of spaced, hinge collars 58*a*, 58*b* and 60*a*, 60*b*. Each of the hinge collars is a hollow, tubular metallic element which may be slipped over the circular rod or wire forming the lateral supports prior to bending or may be split and placed around the rod and thereafter welded along the split line. Top and bottom bars 48, 54 of back support 16 are longer than bars 50, 52 and include outwardly extending end portions 48a, 48b and 54a, 54b which are welded to the central portions of hinge collars 58a, 58b and 60a, 60b respectively In order to vertically position back support 16 with respect to lateral supports 12, 14, the lowermost hinge collar 60a, 60b are confined for limited sliding vertical movement along rear legs 24 by a pair of spherical projections 62, 64 welded adjacent the top and bottom ends of the hinge collars on each rear leg as shown in FIG. 3.

Figure 5:
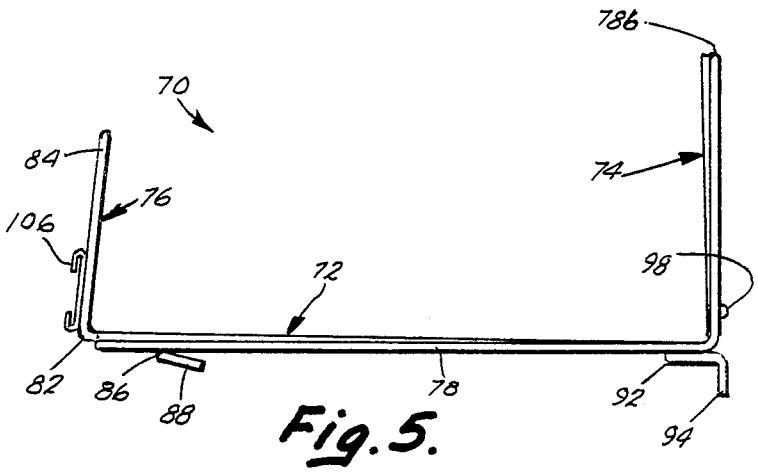
FIG. 5 is a right side elevation of the shelf assembly of FIG. 4.
Figure 6:
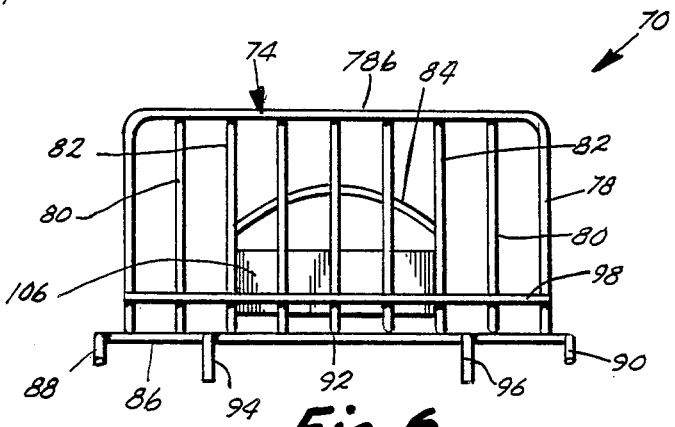
FIG. 6 is a rear elevation of the shelf assembly of FIGS. 4 and 5.

As will now be best understood from FIGS. 4–7, shelf units 70 each comprise an L-shaped unitary assembly formed from steel rod or wire of circular cross section preferably of about one-eighth inch diameter. Each shelf unit 70 includes a lower shelf area 72, a generally upright, rear retention portion or back 74, and a front retention member 76. An outer peripheral rod or wire 78 outlines the entire shelf and back and extends around the entire lower shelf area 72 and upright back or rear portion 74. A series of L-shaped rods or wires 80 are welded between the rod portion 78a at the front edge of the shelf and rod portion 78b at the top edge of the rear retention portion 74 at spaced positions across the width of the shelf unit. Shelf area 72, and thus rods 80, extend forwardly beyond the front surface of front legs 22 such that the shelf protrudes beyond the front of the lateral supports (FIG. 2) to allow easier access to the interior of each shelf area. The second rod or wire 82, when counting in from each lateral edge of each shelf unit, extends beyond the front edge rod 78a and is bent upwardly into a curve 84 extending continuously to the opposite wire rod 82 adjacent the opposite edge of the shelf unit. Bent, curved rod 84 forms front retainer member 76 which, as shown in FIGS. 2 and 5, extends at an acute angle to lower shelf area 72 such that it is parallel to front legs 22 when assembled in support assembly 11. Front retention member 76 holds the product such as baked bread loaves or the like on the lower shelf portion 72 atop wire rods 80, 82. Likewise, rear retention portion 74, which is also at an acute angle to lower shelf area 72 and extends vertically upwardly when assembled to support assembly 11, keeps the bread or other products from falling off the rear of the shelf, especially when rack 10 is tilted for movement Adjacent the front of each shelf unit, a support rod 86 is welded under rods 80, 82 and extends laterally across the entire width of each shelf unit. Ends 88, 90 of rod 86 extend beyond the edges of shelf area 72 and are bent downwardly and rearwardly to form hooks which engage the outer sides of front legs 22 while wire rod sections 78c, 78d immediately to the rear of rod 86 engage spherical projections 91 on the lateral supports 12, 14 for mounting the shelf units on the folding support assembly 11 as described hereinafter. Likewise, adjacent the rear of each shelf unit a support rod 92 is welded under rods 80, 82 but extends only partially across the width of the shelf unit. Rod 92 includes rearwardly and downwardly bent end portions 94, 96 which also form hooks which engage over and behind horizontal bars 48, 50, 52 or 54 for support of the shelf on back support 16 depending on the vertical position of the shelf when assembled. Finally, a third support rod 98 is welded behind rods 80, 82 on the rear retention portion 74 of each shelf unit and extends laterally across the entire width of each shelf unit for additional support of rods 80, 82 and mounting of pivotable header support 120 as is described hereinafter.

As will be best understood from FIG. 3, folding support assembly 11 includes spherical projections 91 on front legs 22 for engaging and supporting the spaced shelf assemblies 70. Projections 91 are preferably welded to the inside surfaces of front legs 22 at equally vertically spaced positions adjacent and below the lower bar of side retainers 100 and 102, and are engaged by wire rod sections 78c, 78d when the shelf units are assembled to the support assembly 11.

In order to retain product such as baked goods on shelf area 72 at the sides of the shelf, side retaining members 100, 102, 104 are welded to the inside surfaces of lateral supports 12, 14 as shown in FIGS. 1–3. Side retaining member 100 is a bent, U-shaped, steel rod or wire spaced between top bar 12 or 14 of each lateral support and shelf area 72 of top shelf 70 (FIGS. 1 and 2) when the collapsible rack is assembled Side retaining member 100 extends between and is welded to rear leg 24 and to front leg 22, and has a front end 101 extending forwardly beyond front leg 22 a distance slightly less than the forward extent of shelf 72 (see FIG. 2).

Adjacent each of the other shelf units 72 below the top shelf at either lateral edge thereof when in the assembled rack are side retaining members 102, 104 (FIGS. 1–3). Side retaining members 102 are bent rods slightly taller than retainers 100 and also extend from rear leg 24 beyond front leg 22 to front ends 103 the same distance as retainer 100. Spaced in the center of each retainer 102, and also extending between rear leg 24 and front leg 20, is a single side retaining member or rod 104. Side retaining members 100, 102, 104, therefore, confine the product atop each shelf area 72 on rods 80, 82 and between front retainer 76 and rear retainer 74 to prevent the product from falling from the rack assembly Ends 101, 103 of side retaining members 100, 102 prevent product on shelves 70 from slipping out between front retainers 76 and front legs 22.

As will be seen from FIG. 2, top bars 18, side retaining members 100, 102, 104, and rods 80, 82 of shelf area 72 are all generally parallel to one another and slope slightly downwardly and forwardly from positions at the rear leg 24. Such forward and downward slope properly displays products for easy viewing and access by customers passing the rack assembly in a store. Front retainers 76 extend upwardly and slightly forwardly a distance approximately one-half that between adjacent shelf areas 72 to provide appropriate access between the shelves for grasping and removing products from the shelves.

As is also shown in FIGS. 1, 2, 4–7, 10 and 11, each front retainer 76 include a card/paper holder 106 which extends laterally across the front retainer approximately in the middle of each shelving unit. As is best seen in FIG. 7, each card/paper holder 106 includes a pair of inwardly facing, L-shaped flanges 108 which form a recess 110 for receiving a rectangular card or other paper P on which indicia such as advertising, trademarks, pricing or other product information may be placed and displayed. The card or paper P may be slid into and out of recess 110 from either end of holder 106 for modification or changing as necessary.

Figure 8:
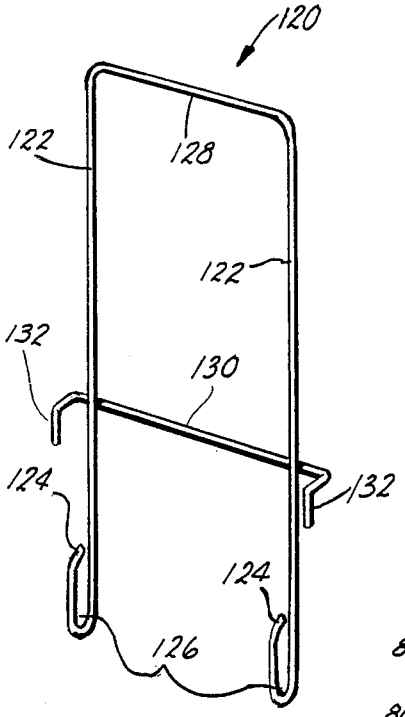
FIG. 8 is a perspective view of the pivotable header support adapted for mounting on the back retention area of the top shelf assembly.
Figure 9:
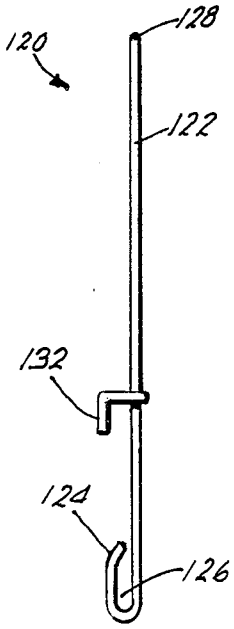
FIG. 9 is a right side elevation of the pivotable header support of FIG. 8.
Figure 4:
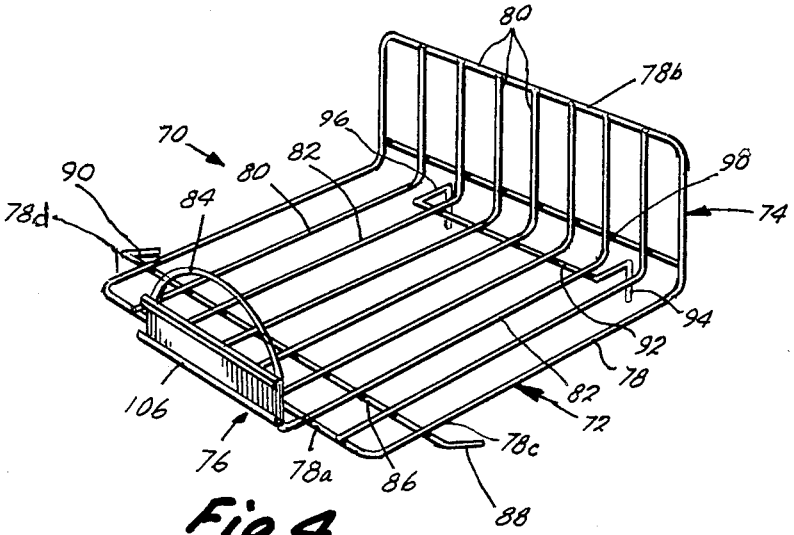
FIG. 4 is a perspective view of one of the several shelf assemblies adapted for support by the foldable support assembly.
Figure 10:
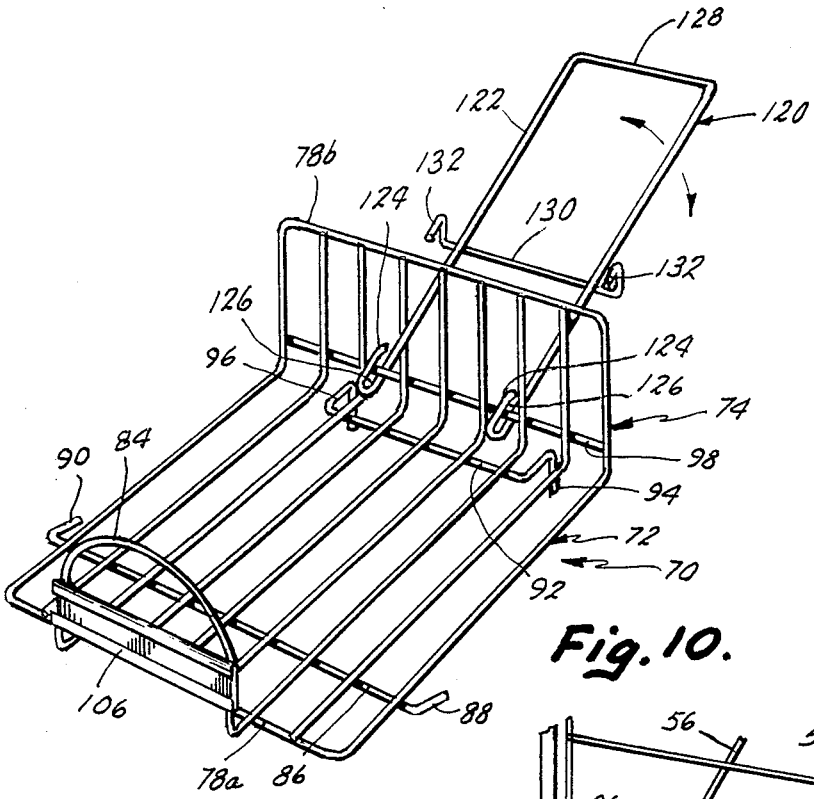
FIG. 10 is a perspective view of the topmost shelf assembly incorporating the pivotable header support shown in partially assembled position.

As is best seen in FIGS. 8–10, pivotable header support 120 is secured to the rear retainer 74 of top shelf unit 70 in order to support advertising header 140 as mentioned above. Each of the rear retention members 74 on shelving units 70 includes a generally horizontally extending, bar or wire rod 98 welded to the exterior surface of rods 80, 82 and extending completely across the lateral width of the shelving unit. Header support 120 is preferably U-shaped, is formed from one-eighth to one-quarter inch steel rod or wire, and is pivotably and slidably secured around bar 98 by means of reverse bends formed in wire ends 124 forming slots 126 in which bar 98 may slide. Closed end 128 of support 120 joins legs 122 and extends upwardly. Another formed wire rod 130 is welded to the exterior of legs 122 and has ends bent forwardly and downwardly to form hooks 132 for engaging the in said surface of top rod or bar **78*b* when support member 120 is in its upright position. As shown in FIG. 2, when hooks 132 engage rod 78*b*, support 120 extends vertically upwardly parallel to back retainer 74**.

In order to pivot header support 120 from the upright position shown in FIGS. 1 and 2 to its lowered position shown in FIG. 10 and in phantom in FIG. 2, top bar 128 is grasped and lifted such that ends 124 are lifted until rod 98 engages the inside ends of slots 126. Simultaneously, hooks 132 are released from the inside surfaces of bar **78*b*. Support member 122 may then be pivoted rearwardly as shown by the arrow in FIG. 10 and lowered such that it extends along the back surface of the display rack as shown in FIG. 2. Typically, support member 120 is lowered during shipment or transportation of the display rack assembly although it may also be lowered to facilitate loading of the top shelf with various products or if use of advertising header 140 is not required. Support 120 is also mountable on whichever of shelf units 70 is at the top of support assembly 11** since the shelf units are identical and interchangeable.

Secured atop pivotable support member 120 is an advertising header or display 140 best seen in FIGS. 1, 2, 12 and 13. Advertising header 140 includes a molded thermoplastic body 142 having a back panel 144, top panel 146, front panel 148 and a diagonal display surface 150 extending between top panel 146 and front panel 148. The bottom of body 142 is open. A molded panel 152 is adhered to the inside surface of back 144 generally at its center. Panel 152 includes an offset area 154 spaced from the inside surface of back 144 forming a narrow pocket or socket 156 which is slightly larger than the diameter of the wire or rod forming U-shaped pivotable header support 120. The closed end 128 of the U-shaped header support 120 is slid into the open bottom of socket 156 until it engages the closed end of the socket to retain advertising header 140 in place as shown in FIGS. 1 and 2.

The open ends of body 142 are closed by molded end panels 158, 160 each of which includes a molded slot or channel 162 which follows the contour of the end edge 151 of body 142. End edges 151 of body 142 are adhered in channels 162 by a suitable adhesive. When assembled as described above, advertising header 140 provides front, rear and end surfaces suitable for imprinting or attachment of various advertising or product information concerning the items to be supported and displayed on rack assembly 10. When supported on assembly 10, the open bottom of advertising header 140 is spaced above top bars 18 sufficiently to allow insertion and removal of items from the top shelf over front retainer 76. Moreover, front panel 148 is positioned approximately half way between front and rear legs 22, 24 respectively, further allowing access to the top shelf support area. The advertising header may be easily slidably attached or removed from the pivotable header support 120 merely by sliding or withdrawing the header support 120 into or from socket 156.

As will now be understood from FIGS. 1–3 and 11, collapsible rack assembly 10 maybe sold as a kit with all necessary parts packed in a carton or shipping container. Assembly of the rack is quickly and easily made by removing folding support assembly 11 from the shipping container and swinging lateral supports 12, 14 outwardly and around vertical uprights 44, 46 on hinge collars **58*a*, 58*b* and 60*a*, 60*b* until the lateral supports are generally parallel to one another and extend perpendicularly to the plane of back support 16. Wheels 36 are then slipped over stub axles 34 via hubs 40 and secured by retaining nuts 42 on the ends of the axles. Folded support assembly 11 is then placed on a support surface such that it is in an upright position on wheels 36 and surface engaging areas 26 at the bottom front corners of bottom bars 20**.

Figure 11:
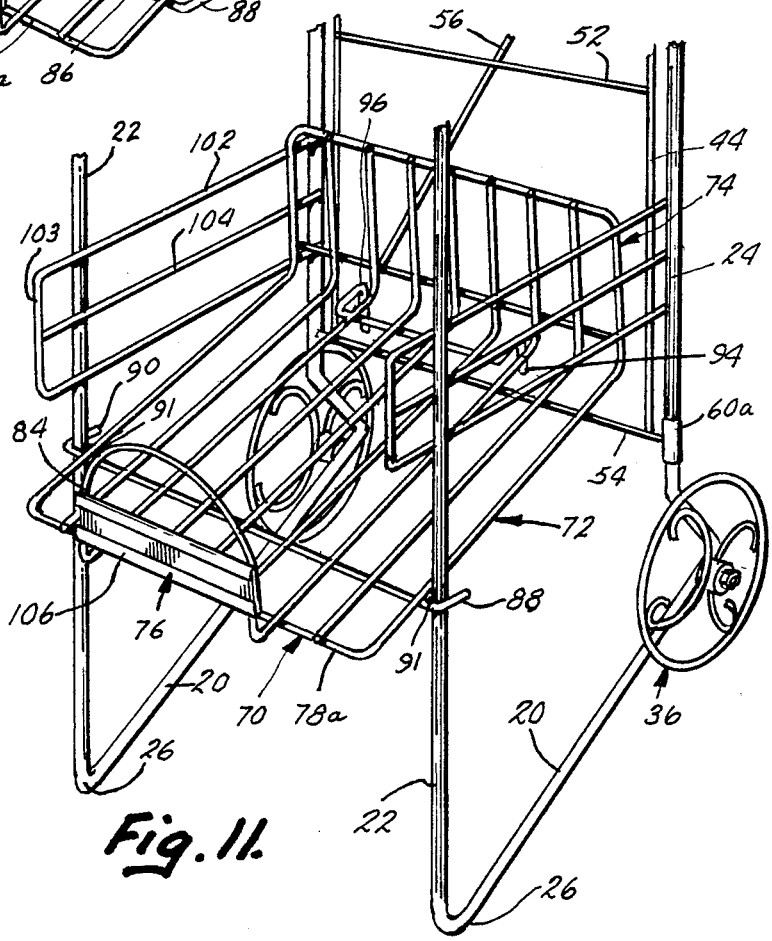
FIG. 11 is a fragmentary, perspective view of the lower portion of the collapsible rack assembly during assembly of the lowermost shelf unit to the folding support assembly.

Thereafter, shelving units 70 are assembled serially to the partially assembled rack. As shown in FIG. 11, it is easiest to begin with the bottom shelf 70 by inserting it back first from the open front of the outwardly folded support assembly 11 and moving it toward the back support 16 until hooks 88, 90 engage around legs 22 and rod portions **78*c*, 78*d* are supported by spherical projections 91. At such time, the rear of shelf unit 70 extends above horizontal bar 54 as shown in FIG. 11. Thereafter, assembly of this shelf unit is completed by lowering the rear of the shelf unit until hooks 94, 96 engage over and rest on horizontal bar 54 as shown in FIG. 2. Subsequently, the second, third and top shelf units are similarly assembled one-by-one to the support assembly in like manner to the respective horizontal bars 52, 50 and 48. Thereafter, advertising header 140 is assembled by sliding pivotable header support 120 onto topmost support bar 98 by sliding the bar through the openings at ends 124 into slots 126. Header support 120 is then pivoted upwardly to a substantially vertical position and pushed downwardly such that hooks 132 engage over wire or rod 78*b* as shown in FIG. 1. Advertising header 140 is slid over the upwardly projecting end 128 of support 120 via socket 156. After appropriate advertising or sign age is applied to the advertising header 140, and appropriate labels or other indicia are inserted in card/paper holders 106, rack 10 may be loaded with product and moved on wheels 36** to a desired display area.

As will now be understood, collapsible display rack 10 includes a series of shelves 70 each of which may be used to support various products or items for display and sale in retail or other stores and allows loading and movement from place to place within the store in a convenient manner. As seen in FIG. 2, the shelves are supported in rack 10 in front of axles 34 and wheels 36 such that the weight of the rack and shelves, together with any products or items supported on the shelves, urges the rack assembly downwardly against the floor engaging areas 26. The display is thus stably supported on a four-point contact with the floor or surface on wheels 36 and floor engaging areas 26. However, when movement of the rack assembly is desired, it need merely be tilted and rotated about axles 34 and wheels 36 to lift the floor engaging areas 26 away from the floor or support surface such that the rack can be pushed or pulled to a different position. During such movement, the rear, front and side retainer elements maintain the products or items supported on the shelf portions 72.

While one form of the invention has been shown and described, other forms will now be apparent to those skilled in the art. Therefore, it will be understood that the embodiment shown in the drawings and described above is merely for illustrative purposes, and is not intended to limit the scope of the invention which is defined by the claims which follow.

The embodiments of the invention in which an exclusive property of privilege is claimed are defined as follows.

1. A collapsible rack assembly for food and other products including bakery goods comprising:

a foldable support assembly having a back support, a pair of lateral supports pivotally secured to said back support, and engaging means for holding a plurality of shelf assemblies on said back and lateral supports, said lateral supports each having top and bottom ends;

a plurality of removable shelf assemblies mounted at vertically spaced positions on said support assembly for access at least from the front of said rack assembly, each shelf assembly having a support area for retaining items thereon and fastening means for removably securing said shelf assemblies on said engaging means;

spaced surface engaging means at said bottom end of said foldable support assembly for supporting said rack assembly in a generally upright position on a support surface/floor;

each of said shelf assemblies including a lower support shelf having front and rear portions; said fastening means including hook means adjacent the front and rear of each of said lower support shelves for attachment to said engaging means;

each of said shelf assemblies also having a generally upright back retention area at the rear of said lower support shelf; said shelf assemblies each including a plurality of spaced rods extending continuously from said back retention area to said front of said lower support shelf with at least one support rod extending across and under at least some of said spaced rods;

said lower support shelves each including two support rods, one adjacent the front and rear thereof; said hook means including bent rod portions extending from opposite ends of each of said support rods.

2. A collapsible rack assembly for food and other products including bakery goods comprising:

a foldable support assembly having a back support, a pair of lateral supports pivotally secured to said back support, and engaging means for holding a plurality of shelf assemblies on said back and lateral supports, said lateral supports each having top and bottom ends;

a plurality of removable shelf assemblies mounted at vertically spaced positions on said support assembly for access at least from the front of said rack assembly, each shelf assembly having a support area for retaining items thereon and fastening means for removably securing said shelf assemblies on said engaging means;

spaced surface engaging means at said bottom end of said foldable support assembly for supporting said rack assembly in a generally upright position on a support surface/floor;

an advertising header spaced above said top ends of said lateral supports; and a top shelf assembly adjacent said top ends of said lateral supports, said top shelf assembly including a generally upright, back retention area; a pivotable header support mounted on said back retention area of said top shelf assembly, said header support being pivotable between an upright position extending above said top ends of said lateral supports and a lowered position extending downwardly along said back support.

3. The rack assembly of claim 2 wherein said pivotable header support includes a bar mounted across said back retention area of said top shelf, a U-shaped support member, slidable pivot means pivotally and slidably joining said U-shaped support member to said bar, and releasable hook means on said U-shaped support at a position spaced from said slidable pivot means for engaging a portion of said back retention area at a position spaced from said bar to hold said pivotable header support in said upright position, but releasing said portion of said back retention area to allow pivotal movement to said lowered position when said U-shaped support is slid upwardly on said slidable pivot means.

4. The rack assembly of claim 2 wherein said advertising display is a hollow body having an open bottom and front, back and ends suitable for attaching or imprinting indicia thereon and socket means opening toward said open bottom for receiving and retaining said pivotable header support therein.

5. A collapsible rack assembly for food and other products including bakery goods comprising:

a foldable support assembly having a back support, a pair of lateral supports pivotally secured to said back support, and engaging means for holding a plurality of shelf assemblies on said back and lateral supports, said lateral supports each having top and bottom ends;

a plurality of removable shelf assemblies mounted at vertically spaced positions on said support assembly for access at least from the front of said rack assembly, each shelf assembly having a support area for retaining items thereon and fastening means for removably securing said shelf assemblies on said engaging means;

spaced surface engaging means at said bottom end of said foldable support assembly for supporting said rack assembly in a generally upright position on a support surface/floor;

hinge means for pivotally securing said back support to said lateral supports;

said lateral supports each being elongated, trapezoidal and including front and rear legs, top and bottom bars interconnecting said front and rear legs, and vertically spaced side retainers; said hinge means including spaced, rotatable hinge collars on said rear leg; said front leg being longer than said rear leg; said bottom bar sloping downwardly from said rear leg toward said front leg and including said surface engaging means.

6. The rack assembly of claim 5 wherein said back support includes a rectangular frame having spaced vertical uprights joined by a plurality of vertically spaced, generally horizontal bars, and a diagonal brace extending across said horizontal bars, the uppermost and bottommost of said horizontal bars being joined to said hinge collars.

7. A collapsible rack assembly for food and other products including bakery goods comprising:

a foldable support assembly having a back support, a pair of lateral supports, hinge means for pivotally securing said back support to said lateral supports, and engaging means for holding a plurality of shelf assemblies on said back and lateral supports, said lateral supports each having top and bottom ends and being pivotable on said hinge means with respect to said back support between assembled and collapsed positions;

a plurality of removable shelf assemblies mounted at vertically spaced positions on said support assembly for access at least from the front of said rack assembly, each shelf assembly having a support area for retaining items thereon and fastening means for removably securing said shelf assemblies on said engaging means;

said lateral supports each including downwardly and forwardly extending surface engaging bars at said bottom end thereof for supporting said rack assembly in a generally upright position on a support surface/floor;

a pair of laterally spaced, laterally aligned wheels, each wheel being rotatably mounted on one of said lateral supports at a position adjacent the rear of said surface engaging bars, said wheels allowing said rack assembly to be tilted rearwardly off said surface engaging bars for movement along the support surface/floor;

said lateral supports each being elongated, trapezoidal and including front and rear legs, top and bottom bars interconnecting said front and rear legs, and vertically spaced side retainers; said hinge means including spaced, rotatable hinge collars on said rear leg; said front leg being longer than said rear leg; said bottom bar sloping downwardly from said rear leg toward said front leg and including a surface engaging area thereon.

8. The rack assembly of claim 7 wherein said back support includes a rectangular frame having spaced vertical uprights joined by a plurality of vertically spaced, generally horizontal bars, and a diagonal brace extending across said horizontal bars, the uppermost and bottommost of said horizontal bars being joined to said hinge collars.

9. A collapsible rack assembly for food and other products including bakery goods comprising:

a foldable support assembly having a back support, a pair of lateral supports, hinge means for pivotally securing said back support to said lateral supports, and engaging means for holding a plurality of shelf assemblies on said back and lateral supports, said lateral supports each having top and bottom ends and being pivotable on said hinge means with respect to said back support between assembled and collapsed positions;

a plurality of removable shelf assemblies mounted at vertically spaced positions on said support assembly for access at least from the front of said rack assembly, each shelf assembly having a support area for retaining items thereon and fastening means for removably securing said shelf assemblies on said engaging means;

said lateral supports each including downwardly and forwardly extending surface engaging bars at said bottom end thereof for supporting said rack assembly in a generally upright position on a support surface/floor;

a pair of laterally spaced, laterally aligned wheels, each wheel being rotatably mounted on one of said lateral supports at a position adjacent the rear of said surface engaging bars, said wheels allowing said rack assembly to be tilted rearwardly off said surface engaging bars for movement along the support surface/floor;

an advertising header spaced above said top ends of said lateral supports; and a top shelf assembly adjacent said top ends of said lateral supports, said top shelf assembly including a generally upright, back retention area; a pivotable header support mounted on said back retention area of said top shelf assembly, said header support being pivotable between an upright position extending above said top ends of said lateral supports and a lowered position extending downwardly along said back support; said advertising header being mounted on said header support.

10. A kit for making a collapsible rack assembly for food and other products including bakery goods comprising:

a foldable support assembly having a back support, a pair of lateral supports pivotally secured to said back support, and engaging means for holding a plurality of shelf assemblies on said back and lateral supports, said lateral supports each having top and bottom ends, surface engaging means at said bottom ends thereof, and wheel support means at a position spaced from said surface engaging means;

a plurality of removable shelf assemblies, each shelf assembly including a support area for retaining items thereon and fastening means for removably securing said shelf assemblies on said engaging means;

a pair of wheels, one wheel adapted to be supported on said wheel support means on each of said lateral supports;

hinge means for pivotally securing said back support to said lateral supports;

said lateral supports each being elongated, trapezoidal and including front and rear legs, top and bottom bars interconnecting said front and rear legs, and vertically spaced side retainers; said hinge means including spaced, rotatable hinge collars on said rear leg; said front leg being longer than said rear leg; said bottom bar sloping downwardly from said rear leg toward said front leg and including said surface engaging means.

11. The kit of claim 10 wherein said back support includes a rectangular frame having spaced vertical uprights joined by a plurality of vertically spaced, generally horizontal bars, and a diagonal brace extending across said horizontal bars, the uppermost and bottom most of said horizontal bars being joined to said hinge collars.

12. A kit for making a collapsible rack assembly for food and other products including bakery goods comprising:

a foldable support assembly having a back support, a pair of lateral supports pivotally secured to said back support, and engaging means for holding a plurality of shelf assemblies on said back and lateral supports, said lateral supports each having top and bottom ends, surface engaging means at said bottom ends thereof, and wheel support means at a position spaced from said surface engaging means;

a plurality of removable shelf assemblies, each shelf assembly including a support area for retaining items thereon and fastening means for removably securing said shelf assemblies on said engaging means;

a pair of wheels, one wheel adapted to be supported on said wheel support means on each of said lateral supports;

a top shelf assembly adjacent said top ends of said lateral supports, said top shelf assembly including a generally upright, back retention area; a pivotable header support mounted on said back retention area of said top shelf assembly, said header support being pivotable between an upright position extending above said top ends of said lateral supports and a lowered position extending downwardly along said back support.

* * * * *

UNITED STATES PATENT AND TRADEMARK OFFICE

CERTIFICATE OF CORRECTION

PATENT NO. : 4,978,013

DATED : December 18, 1990

INVENTOR(S) : Howard Hogg

It is certified that error appears in the above-identified patent and that said Letters Patent is hereby corrected as shown below:

Column 1, line 28:

After "store" insert --.--

Column 1, line 37:

After "location" insert --.--

Column 1, line 41:

After "together" insert --.--

Column 2, line 8:

After "assembly" insert --.--

Column 2, line 48:

"include" should be --included--

Column 3, line 21:

After "invention" insert --when--

Column 3, line 32:

After "for" insert --displaying--

UNITED STATES PATENT AND TRADEMARK OFFICE

CERTIFICATE OF CORRECTION

PATENT NO. : 4,978,013

DATED : December 18, 1990

INVENTOR(S) : Howard Hogg

It is certified that error appears in the above-identified patent and that said Letters Patent is hereby corrected as shown below:

Column 3, line 64:

After "surface" insert --.--

Column 4, line 1:

After "store" insert --.--

Column 4, line 14:

After "respectively" insert --.--

Column 5, line 3:

After "respectively" insert --.--

Column 5, line 43:

After "movement" insert --.--

Column 6, line 15:

After "assembled" insert --.--

Column 6, line 33:

After "assembly" insert --.--

UNITED STATES PATENT AND TRADEMARK OFFICE

CERTIFICATE OF CORRECTION

PATENT NO. : 4,978,013

DATED : December 18, 1990

INVENTOR(S) : Howard Hogg

It is certified that error appears in the above-identified patent and that said Letters Patent is hereby corrected as shown below:

Column 7, line 8:

"in said" should be --inside--

Column 7, line 68:

"maybe" should be --may be--

Column 8, line 39:

"sign age" should be --signage--

Signed and Sealed this

Twelfth Day of May, 1992

*Attest:*

DOUGLAS B. COMER

*Attesting Officer*

*Acting Commissioner of Patents and Trademarks*